US007832152B2

(12) United States Patent
Smith

(10) Patent No.: US 7,832,152 B2
(45) Date of Patent: Nov. 16, 2010

(54) ALIGNMENT OF POSTS TO ACCOMMODATE BARRIER SECTIONS

(75) Inventor: Timothy M. Smith, Fort Lauderdale, FL (US)

(73) Assignee: State Contracting & Engineering Corporation, Hollywood, FL (US)

( * ) Notice: Subject to any disclaimer, the term of this patent is extended or adjusted under 35 U.S.C. 154(b) by 0 days.

(21) Appl. No.: 12/414,859

(22) Filed: Mar. 31, 2009

(65) Prior Publication Data

US 2010/0247246 A1 Sep. 30, 2010

(51) Int. Cl.
*E04B 9/00* (2006.01)
*E04C 3/00* (2006.01)

(52) U.S. Cl. ..... 52/126.5; 52/126.1; 52/126.3; 52/243.1; 52/238.1; 52/849; 52/843; 52/844; 52/854

(58) Field of Classification Search ..... 52/126.5, 52/126.1, 126.3, 243.1, 238.1, 849, 843, 52/844, 854
See application file for complete search history.

(56) References Cited

U.S. PATENT DOCUMENTS 3,447,106 A * 5/1969 Jameel ..... 335/140
3,605,851 A * 9/1971 Miles et al. ..... 160/135
3,828,937 A * 8/1974 Nash ..... 211/107
4,023,374 A * 5/1977 Colbert et al. ..... 405/216
4,125,975 A * 11/1978 Soble ..... 52/126.1
4,345,734 A * 8/1982 Studinger ..... 248/669
4,448,003 A * 5/1984 Hasbrouck ..... 52/239
4,971,593 A * 11/1990 Mayhall et al. ..... 211/70
5,661,946 A * 9/1997 Davis ..... 52/849
6,082,058 A * 7/2000 Deng ..... 52/125.1
6,289,636 B1 * 9/2001 White et al. ..... 52/40
6,430,880 B1 * 8/2002 Kemeny ..... 52/71
6,446,411 B2 * 9/2002 Natelli, Jr. ..... 52/836
6,991,245 B1 * 1/2006 Pate, Jr. ..... 280/414.1
7,055,251 B1 * 6/2006 Smith et al. ..... 33/1 H
7,191,528 B2 * 3/2007 Smith et al. ..... 33/1 H
7,243,473 B2 * 7/2007 Terrels ..... 52/843
7,451,720 B2 * 11/2008 Somers ..... 116/173

* cited by examiner

*Primary Examiner*—Richard E Chilcot, Jr.
*Assistant Examiner*—Mark R Wendell
(74) *Attorney, Agent, or Firm*—Steven M. Greenberg, Esq.; Scott D. Paul, Esq.; Carey Rodriguez Greenberg & Paul LLP

(57) ABSTRACT

The present invention provides a system for adjusting a position of a post within a pile. The system includes a post including a vertical groove on one side and a vertical groove on another side for accommodating a sound wall panel. The system also includes a pile including a vertical bore into which the post is inserted. A set of three screws are spaced evenly around an exterior circumference of the post near a bottom of the post, wherein at least one screw contacts an interior circumference of the bore so as to adjust a position of the post within the bore. The system further includes a collar for fastening the post to a top of the pile at an opening of the bore.

20 Claims, 5 Drawing Sheets

ALIGNMENT OF POSTS TO ACCOMMODATE BARRIER SECTIONS

FIELD OF THE INVENTION

The invention disclosed broadly relates to the field of commercial construction of vertical highway barriers, and more particularly relates to the alignment of posts within piles or foundations so as to accommodate panels or portions of highway barriers.

BACKGROUND OF THE INVENTION

Various types of vertical highway barriers exist. One type of barrier, a sound wall, is used for stopping or hindering highway noise from polluting neighboring areas. A sound wall comprises rectangular planar sections, referred to as sound wall panels, which are coupled or adjoined together at posts that are affixed to the ground. Each post includes a groove on each side that faces a sound wall panel. The left side of a panel is slid into the rightward-facing groove of a first post and the right side of the panel is slid into the leftward-facing groove of a second post. In this manner, the panel is held up vertically by the first and second posts. Next, the left side of a second panel is slid into the rightward-facing groove of the second post, and so on and so forth. Thus, each post is coupled to and provides support for two separate panels of a sound wall for a highway. For this reason, each panel must fit snugly between two posts. Therefore, each post must be aligned to within a very small margin of error so as to meet this criterion.

Various factors can hinder the adequate alignment of posts required to accommodate panels between them. Human error and the limitations of surveying equipment may result in the inadequate alignment of a post. Alternatively, certain types of ground or soil can be particularly problematic, such as sand, loose aggregate or ground with a high liquid content, such as swamps, peat bogs and marshes. In such ground conditions problems arise from the inadequate support for the post upon insertion. The use of a pile, which typically comprises a heavy cylindrical object placed in the ground and serving as a support or foundation for the post, can mitigate this problem.

A pile may comprise a metal cylindrical object, such as a pipe, that is driven into the ground with a pile driver of the impact or vibratory type. Alternatively, a grout pile may be poured into a hole drilled into the ground. Such an auger cast pile is installed by rotating a hollow shaft auger (or large screw) into the ground to a specified depth. Grout is then pumped under pressure through the hollow shaft as the auger is slowly withdrawn. The resulting grout column hardens and forms an auger cast pile. A post is then coupled with the pile in some manner, typically by inserting the post into an orifice in the pile or into the pile itself. Alignment of the post within the pile, however, can be difficult.

Due to ground instability, equipment limitations or shifting due to freeze/thaw cycles, the pile may shift, lean or fall off alignment, since it is not anchored in a firm base. In this case, if the post is coupled collinearly with the pile, then the post will be misaligned by the same amount. Further, even if the pile is aligned correctly, the bore within the pile that receives the post may be off-alignment. In this case, when the post is inserted within the bore, then the post will be misaligned by the same amount. Additionally, the width of the bore within the pile that receives the post may be significantly larger than the width of the post, thereby producing a significant amount of play when the post is inserted into the bore. This may further cause the post to be misaligned.

Further, misalignment of one post can propagate to other posts. Because each panel is nearly rectangular, sequential posts must be nearly parallel. For example, if a first post is slightly misaligned toward a panel, then the post supporting the other end of the same panel must be slightly misaligned away from the panel. Thus, a slight misalignment of a first post results in the forced misalignment of a second post.

One approach to the problem of alignment of posts in this situation involves manually checking the post before or during insertion of a panel coupled to that post. Then, using a crane or other heavy equipment, the post is moved into a position of alignment. Often, many attempts must be made until alignment is reached. This approach, however, is cumbersome, labor-intensive and time consuming to execute. Thus, the above approach does not provide an easy and quick means of aligning a post within an already existing pile or foundation so as to accommodate a sound wall panel.

Another approach to the problem of alignment of posts in this situation involves the use of a large template that rests on the ground to support and align the post until the pile grout hardens. The template, however, requires considerable space and is problematic in soft ground. Further, these templates cannot be used in water without temporary support piles.

Therefore, a need exists to overcome the problems with the prior art as discussed above, and particularly for a more efficient way to adequately align a post that is placed within a pile or foundation so as to accommodate a sound wall panel.

SUMMARY OF THE INVENTION

Briefly, according to an embodiment of the present invention, an apparatus for adjusting a position of a post within a pile is disclosed. The apparatus includes a pile including a vertical bore into which a post is inserted. The apparatus further includes a set of three screws spaced evenly around an exterior circumference of the post near the bottom of the post, wherein at least one screw contacts an interior circumference of the bore so as to adjust a position of the post within the bore.

In another embodiment of the present invention, a system for adjusting a position of a post within a pile is disclosed. The system includes a post including a vertical groove on one side and a vertical groove on another side and a pile including a vertical bore into which the post is inserted. The system further includes a set of three screws spaced evenly around an exterior circumference of the post near a bottom of the post, wherein at least one screw contacts an interior circumference of the bore so as to adjust a position of the post within the bore.

In another embodiment of the present invention, an alternative system for adjusting a position of a post within a pile is disclosed. The system includes a pile including a vertical bore into which a post is inserted and a set of three screws spaced evenly around an exterior circumference of the post near a bottom of the post, wherein at least one screw contacts an interior circumference of the bore so as to adjust a position of the post within the bore. The system further includes a collar for fastening the post to the pile at an opening of the bore.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

The present invention provides a system for adjusting a position of a post within a pile. The system includes a post including a vertical groove on one side and a vertical groove on another side for accommodating a wall panel. The system also includes a pile including a vertical bore into which the post is inserted. The system also includes a set of three screws spaced evenly around an exterior circumference of the post near a bottom of the post, wherein at least one screw contacts an interior circumference of the bore so as to adjust a position of the post within the bore. The system further includes a collar for fastening the post to the pile at an opening of the bore.

Figure 1:
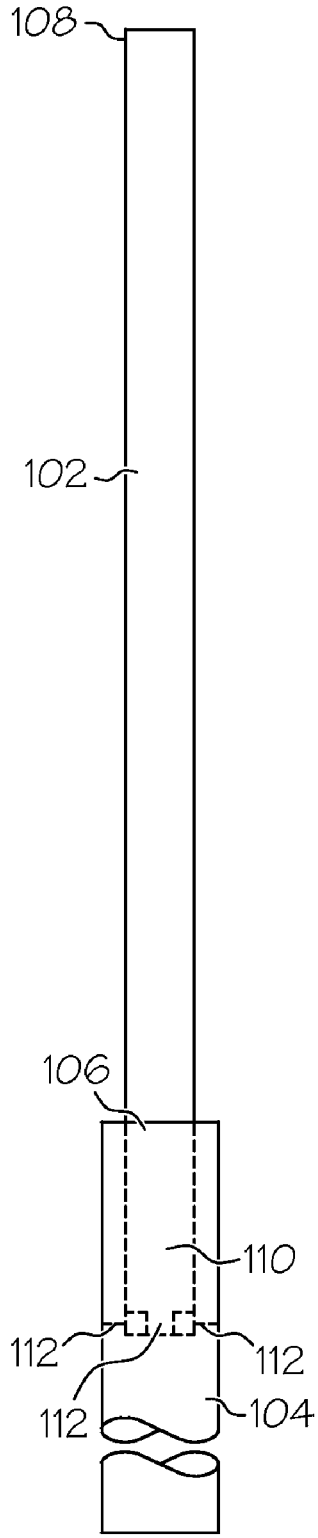
FIG. 1 is an illustration of a side cross sectional view of a post inserted into a supporting and aligning pile, according to one embodiment of the present invention.

FIG. 1 is an illustration of a side cross sectional view of a post 102 inserted into a supporting and aligning pile 104, according to one embodiment of the present invention. The post 102 may comprise a vertical elongated element having an H-beam shaped cross section for the portion of the post 102 that is not inserted into the pile 104. The post 102 may be fabricated of concrete. FIG. 1 shows that the post 102 is inserted or lowered into a vertical channel or bore 106 in the pile 104.

At the bottom of the post 102 is located a set of three horizontal screws 112 spaced evenly around an exterior circumference of the post 102, wherein each screw 112 extends from a center of the post 102 to an exterior circumference of the post 102 and wherein at least one screw 112 contacts an interior circumference of the bore 106 so as to adjust a position of the post 102. More detail on the three screws 112 is provided below.

In one embodiment of the present invention, about 5 feet of the bottom end 110 of the post 102 is inserted into the bore 106. In another embodiment of the present invention, a crane or similar machine holds the top end 108 of the post 102 and lowers it into the bore 106. As the bottom end 110 of the post 102 is inserted into the bore 106, the interior circumference of the bore 106 contacts the distal most portions of the three screws 112, which dictate the position of the post 102 within the pile 104. After insertion of the post 102 into the pile 104, the cavity between the post 102 and the pile 104 is filled with concrete or grout.

Not shown in FIG. 1 is a collar for fastening the post 102 to the pile 104 at the opening of the bore 106 some distance above the set of three screws 112. The collar comprises an apparatus that surrounds the post 102 at the opening of the bore 106 and fastens the post 102 to the pile 104. After insertion of the post 102 into the pile 104 and prior to filling of the cavity between the post 102 and the pile 104, the collar is attached so as to fasten the post 102 to the pile 104 at the opening of the bore 106. This arrangement holds the post 102 in a particular position of alignment while the poured concrete or grout is placed and allowed to harden. The collar is described in more detail below with reference to FIGS. 6 and 7.

In one embodiment of the present invention, the pile 104 is a cylindrical metallic pipe that is driven into the ground using a pile driver of the impact or vibratory type. Sample dimensions of such a metallic cylindrical pipe include 25 feet of length, 32 inches of diameter, and ⅜ inch of pipe wall thickness.

Figure 2:
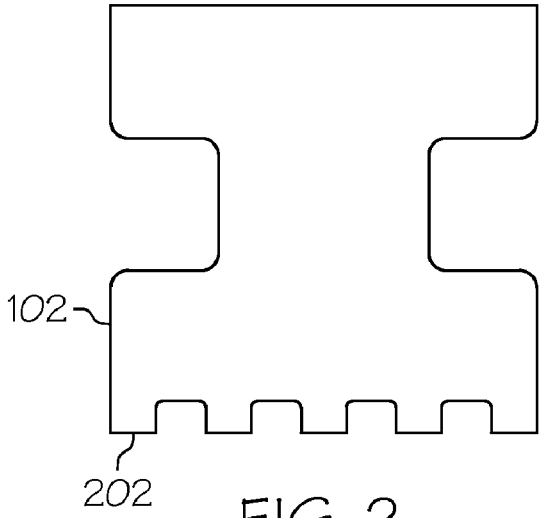
FIG. 2 is an illustration of a top cross sectional view of the post of FIG. 1.

FIG. 2 is an illustration of a top cross sectional view of the post 102 of FIG. 1 taken at a horizontal plane located near a midpoint of post 102. FIG. 2 shows that post 102 has an H-beam shaped cross section for the portion of the post 102 that is not inserted into the pile 104. The post 102 may be about 18 inches wide with a depth of about 16.75 inches. FIG. 2 further shows a set of serrations or undulating portions 202 on the front wall of the post 102, which corresponds to sound dampening features of the post 102, thereby complementing the sound dampening features of the sound wall panel that is supported by the post 102.

Figure 3:
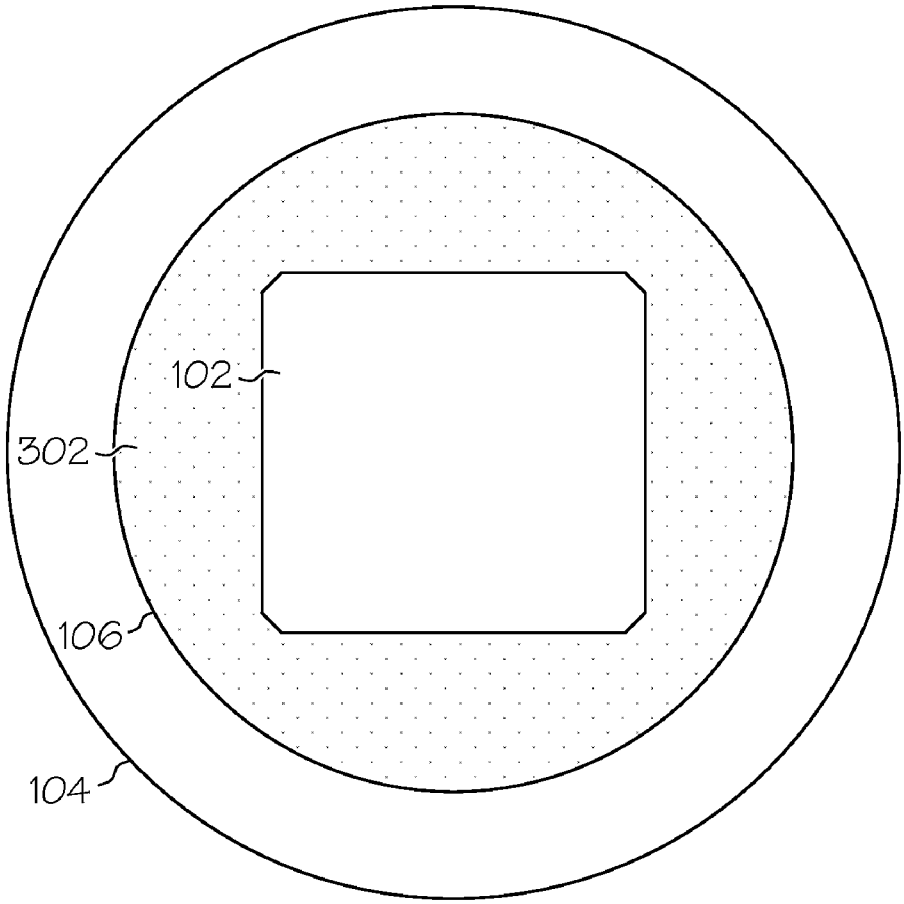
FIG. 3 is an illustration of a top cross sectional view of the pile of FIG. 1 with post inserted.

FIG. 3 is an illustration of a top cross sectional view of the post 102 and the pile 104 shown in FIG. 1, taken at a horizontal plane located near the opening of the bore 106. FIG. 3 shows that the pile 104 has a circular-shaped outer surface and the bore 106 has a similar circular shape. The post 102 has a substantially square shape with rounded vertices, so as to fit within the bore 106. After insertion of the post 102 into the pile 104, the cavity 302 between the post 102 and the pile 104 is filled with concrete or grout.

Figure 4A:
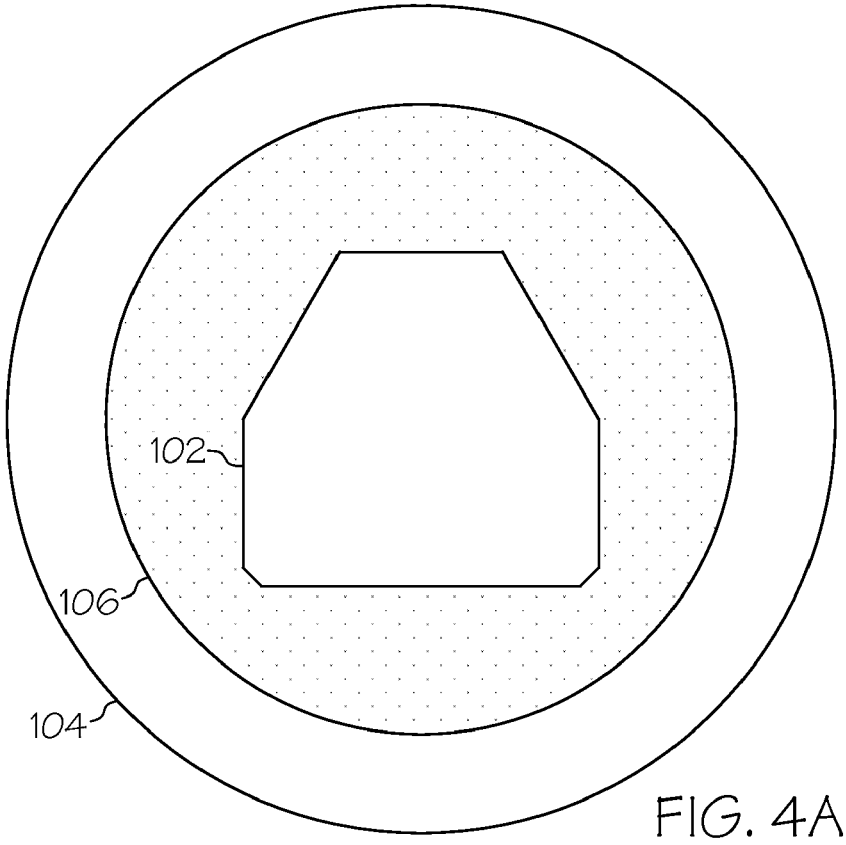
FIG. 4A is an illustration of another top cross sectional view of the pile of FIG. 1 with post inserted. The cross section is taken at the bottom of the post.

FIG. 4A is an illustration of another top cross sectional view of the post 102 and the pile 104 of FIG. 1, taken at a horizontal plane located near a bottom of the bore 106 but above the set of three screws. FIG. 4A shows that the pile 104 has a circular-shaped bore 106 and the post 102 has a substantially uneven hexagon shape with some rounded vertices, so as to fit within the bore 106. An uneven hexagon shape refers to a six-sided polygon wherein each vertex is not congruent. The uneven hexagon shape of the post 102 exists only in the vicinity of the bottom 110 of the post 102.

Figure 4B:
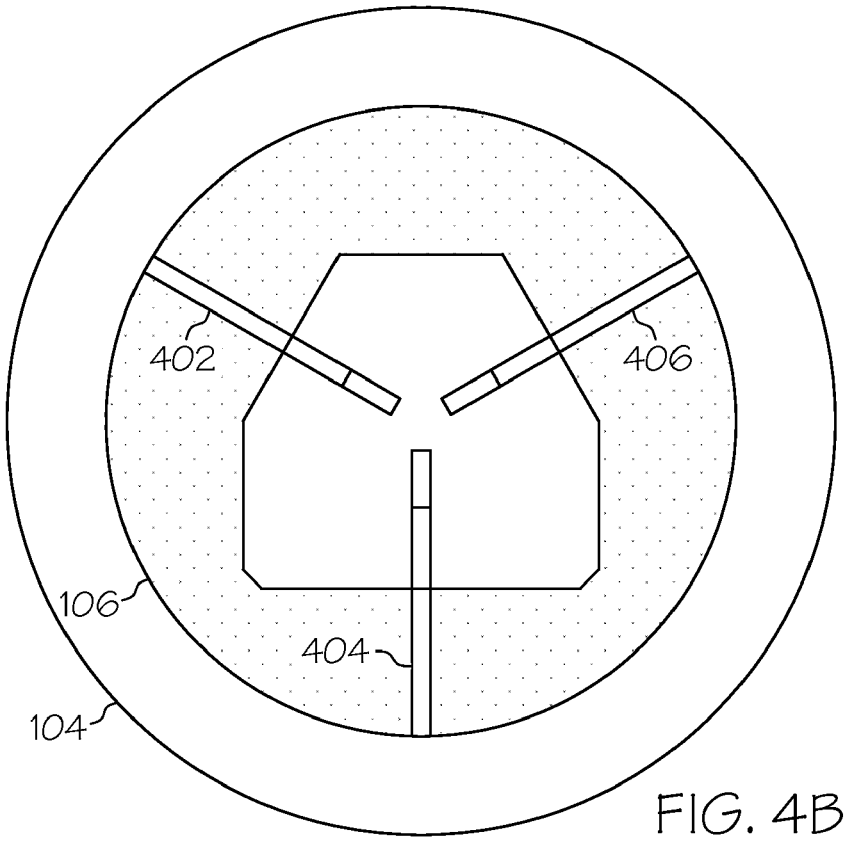
FIG. 4B is an illustration of another top cross sectional view of the pile of FIG. 1 with post inserted. The cross section is taken at the bottom of the post.

FIG. 4B is an illustration of another top cross sectional view of the pile 104 of FIG. 1, taken at a horizontal plane 124 located near a bottom of the bore 106. FIG. 4B shows that the pile 104 has a circular-shaped outer surface, while the bore 106 has a substantially uneven hexagon shape with some rounded vertices.

FIG. 4B further shows three screws 402, 404, 406 spaced evenly every 120 degrees apart around an exterior circumference of the post 102. Each screw 402, 404, 406 extends from an interior of the post 102, through the exterior circumference of the post 102 and contacting the interior circumference of the bore 106. The screws can be turned into and out of the post 102 as desired. At least one screw 402, 404, 406 contacts the interior circumference of the bore 106 so as to adjust a position of the post 102. Each screw comprises a head including a depression for rotating the screw with a tool, a shaft including a threaded exterior that extends into the post 102 and an end that contacts the interior circumference of the bore 106. Sample dimensions of the screws 402, 404, 406 are about ¾ inch thick and about 7 inches long.

Figure 5:
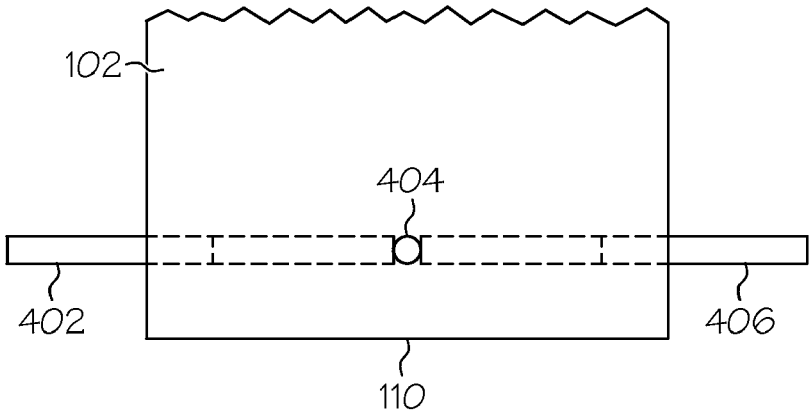
FIG. 5 is an illustration of a side cross sectional view of the bottom of the post and pile of FIG. 1.

FIG. 5 is an illustration of a side cross sectional view of the post 102 of FIG. 1, taken at a vertical plane located near a bottom of the post 102. FIG. 5 shows three screws 402, 404, 406 spaced evenly around an exterior circumference of the post 102. As explained above, the post 102 has a substantially uneven hexagon shape at bottom 110 of the post 102 so as to fit within the substantially circular shape of the bore 106 of pile 104.

Figure 6:
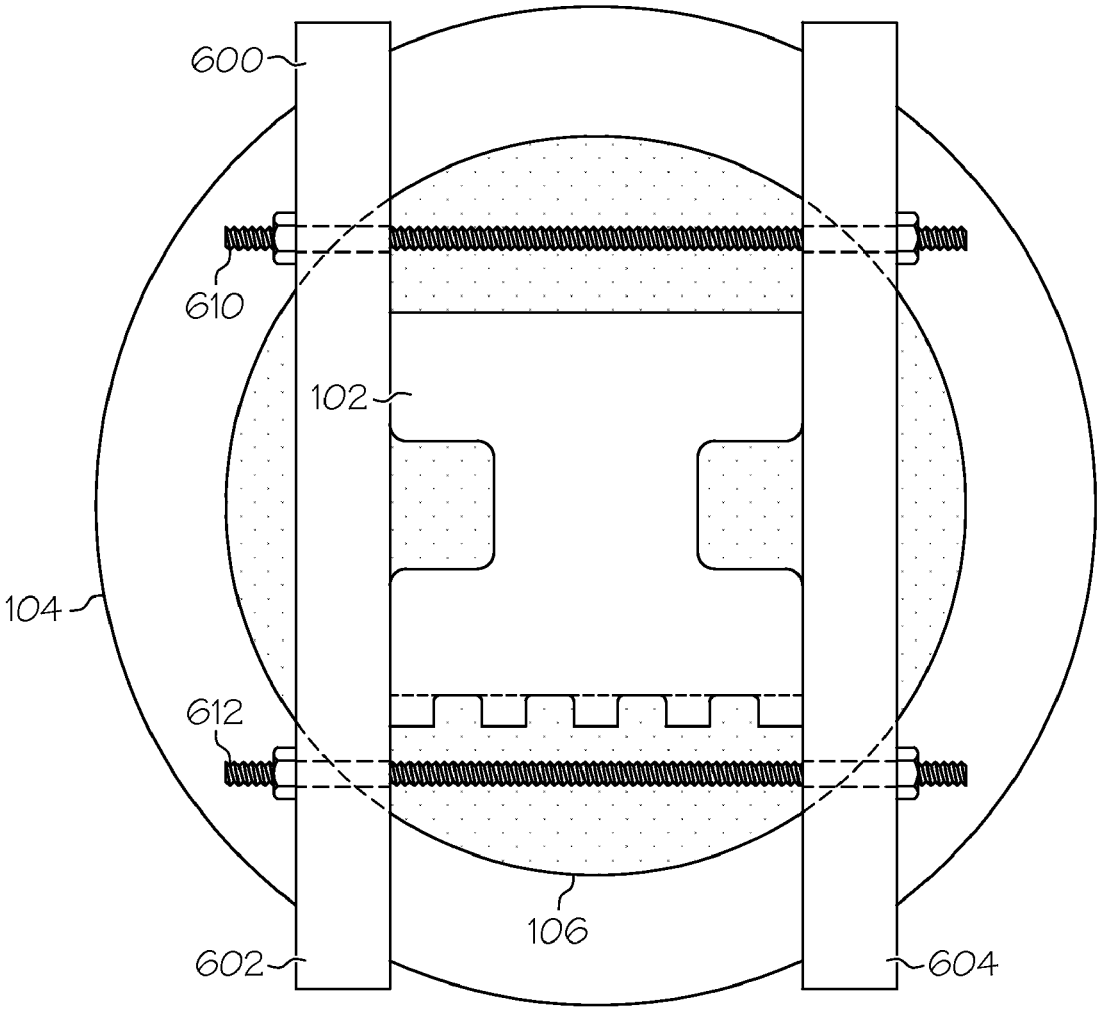
FIG. 6 is an illustration of a top view of a collar for aligning the post, in accordance with one embodiment of the present invention.

FIG. 6 is an illustration of a top view of a collar 600 for aligning the post 102, in accordance with one embodiment of the present invention. FIG. 6 shows a collar 600 for fastening the post 102 to the pile 104 at the opening of the bore 106 some distance above the set of three screws 112. The collar 600 comprises an apparatus that surrounds the post 102 at the opening of the bore 106 and fastens the post 102 to the pile 104. After insertion of the post 102 into the pile 104 and prior to filling of the cavity between the post 102 and the pile 104, the collar 600 is attached so as to fasten the post 102 to the pile 104 at the opening of the bore 106. This arrangement holds the post 102 in a particular position of alignment while the poured concrete hardens.

Collar 600 comprises two wooden planks 602, 604 (such as 4 inch by 6 inch timber of three to six feet long) arranged vertically on either side of the post 102 and resting on the pile 104. Collar 600 also includes two coil rods 610, 612 (such as ¾ inch in diameter) arranged horizontally on either top of and below the post 102. Coil rod 610 intersects with and extends through holes along the top of planks 602, 604. Coil rod 610 is secured to the planks 602, 604 with bolts on each end that may include washers. Likewise, coil rod 612 intersects with and extends through holes along the bottom of planks 602, 604. Coil rod 612 is secured to the planks 602, 604 with bolts on each end that may include washers.

Figure 7:
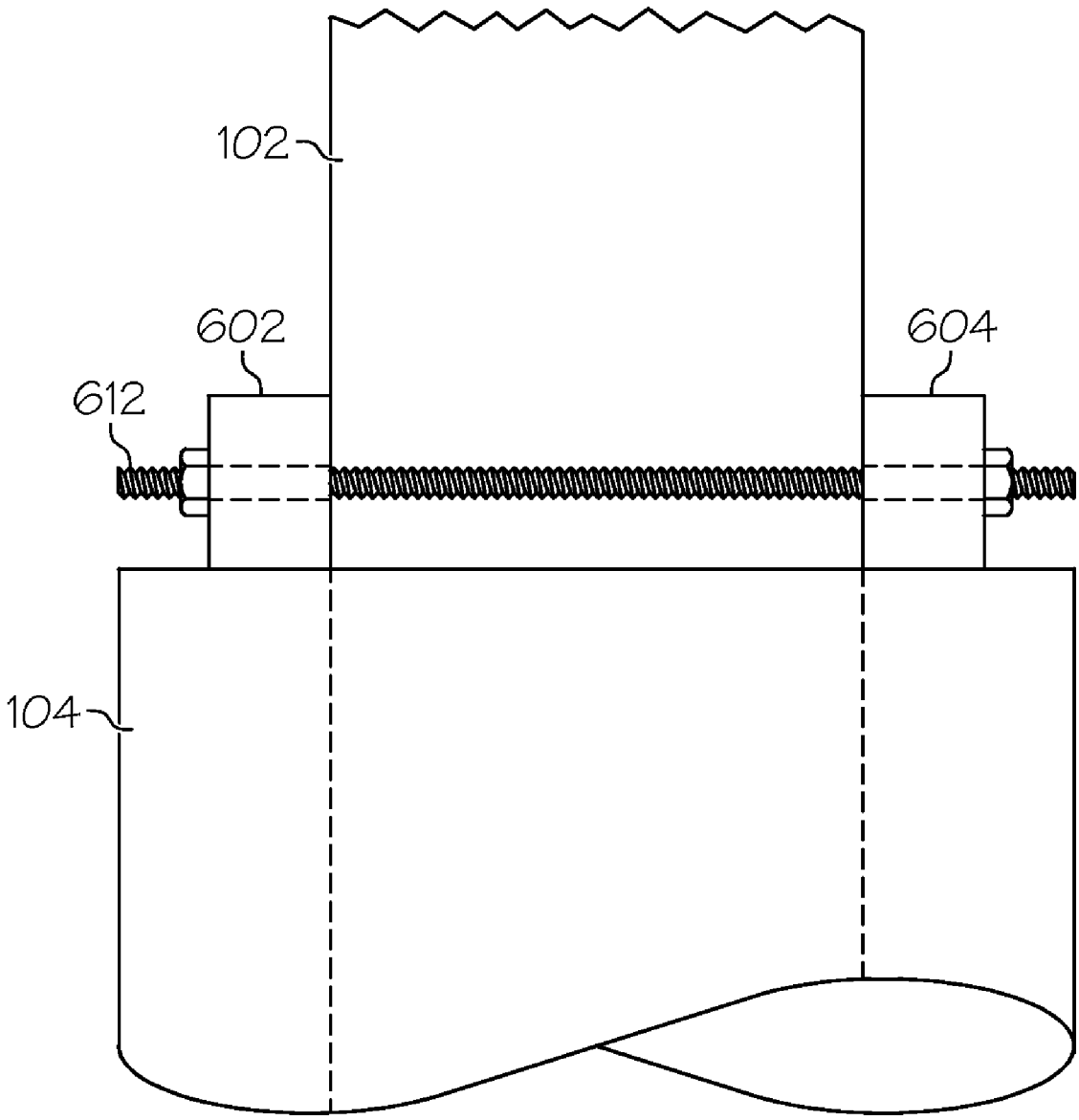
FIG. 7 is an illustration of a side view of the collar of FIG. 6.

FIG. 7 is an illustration of a side view of the collar of FIG. 6. FIG. 7 shows collar 600 fastening the post 102 to the pile 104 at the opening of the bore 106. The collar 600 surrounds the post 102 at the opening of the bore 106 and fastens the post 102 to the pile 104. This arrangement holds the post 102 in a particular position of alignment. The planks 602, 604 provide pressure upon the sides of the post 102, thereby holding it in place. The coil rods, 610, 612 tighten the planks to maintain pressure form the sides of the post 102.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. An apparatus for adjusting a position of a post within a pile, comprising:

a pile including a vertical bore into which a post is inserted; and a set of three screws spaced evenly around an exterior circumference of the post near a bottom of the post, wherein at least one screw contacts an interior circumference of the bore so as to adjust a position of the post within the bore.

2. The apparatus of claim 1, wherein the pile comprises a substantially cylindrical-shaped grout or concrete pile.

3. The apparatus of claim 2, wherein a cross-sectional shape of the post at an opening of the bore is substantially a square.

4. The apparatus of claim 3, wherein a cross-sectional shape of the post at a bottom of the bore is substantially an uneven hexagon.

5. An apparatus for adjusting a position of a post within a pile, comprising:

a pile including a vertical bore into which a post is inserted; and a set of three screws spaced evenly around an exterior circumference of the post near a bottom of the post, wherein at least one screw contacts an interior circumference of the bore so as to adjust a position of the post within the bore, and each of the three screws extends radially through a hole from a center of the post to an exterior surface of the post.

6. The apparatus of claim 5, wherein each screw comprises:

a head including a depression for rotating the screw with a tool;

a shaft including a threaded exterior that extends through the post; and an end that contacts the interior circumference of the bore.

7. The apparatus of claim 5, wherein the three screws are positioned 120 degrees apart from each other around the exterior circumference of the post near the bottom of the post.

8. A system for adjusting a position of a post within a pile, comprising:

a post including a vertical groove on one side and a vertical groove on another side;

a pile including a vertical bore into which the post is inserted; and a set of three screws spaced evenly around an exterior circumference of the post near a bottom of the post, wherein at least one screw contacts an interior circumference of the bore so as to adjust a position of the post within the bore.

9. The system of claim 8, wherein the pile comprises a substantially cylindrical-shaped grout or concrete pile.

10. The system of claim 9, wherein a cross-sectional shape of the post at the opening of the bore is substantially a square.

11. The system of claim 10, wherein a cross-sectional shape of the post at the bottom of the post is substantially an uneven hexagon.

12. The system of claim 11, wherein each of the three screws extends radially through a hole from a center of the post to an exterior surface of the post.

13. The system of claim 12, wherein each screw comprises:

a head including a depression for rotating the screw with a tool;

a shaft including a threaded exterior that extends through the post; and an end that contacts the interior circumference of the bore.

14. The system of claim 13, wherein the three screws are positioned 120 degrees apart from each other around the exterior circumference of the post near the bottom of the post.

15. A system for adjusting a position of a post within a pile, comprising: a pile including a vertical bore into which a post is inserted;

a set of three screws spaced evenly around an exterior circumference of the post near a bottom of the post, wherein at least one screw contacts an interior circumference of the bore so as to adjust a position of the post within the bore; and a collar for fastening the post to a top of the pile at an opening of the bore.

16. The system of claim 15, wherein the pile comprises a substantially cylindrical-shaped grout or concrete pile.

17. The system of claim 16, wherein a cross-sectional shape of the post at the opening of the bore is substantially a square.

18. The system of claim 17, wherein a cross-sectional shape of the post at a bottom of the bore is substantially an uneven hexagon.

19. The system of claim 18, wherein the collar comprises an apparatus that surrounds the post at the opening of the bore and fastens the post to the pile.

20. The system of claim 19, wherein each of the three screws extends radially through a hole from a center of the post to an exterior surface of the post.

* * * * *